US006016636A

United States Patent [19]

Caputo

[11] Patent Number: 6,016,636

[45] Date of Patent: Jan. 25, 2000

[54] MODULAR SHIP'S CABIN AND METHOD OF INSTALLATION

[75] Inventor: James T. Caputo, San Diego, Calif.

[73] Assignee: Hopeman Brothers Marine Interiors LLC, Waynesboro, Va.

[21] Appl. No.: 09/090,490

[22] Filed: Jun. 4, 1998

[51] Int. Cl.[7] ..... B63B 29/02

[52] U.S. Cl. ..... 52/745.2; 52/745.19; 52/745.02; 52/745.1; 52/79.5; 52/236.7; 114/71; 114/189

[58] Field of Search ..... 52/745.19, 745.2, 52/745.02, 745.1, 79.5, 79.6, 106, 65, 236.3, 236.7, 234; 114/71, 189

[56] References Cited

U.S. PATENT DOCUMENTS

| | | | |
|---|---|---|---|
| 2,079,635 | 5/1937 | Sharp . | |
| 3,651,776 | 3/1972 | Hopeman, Jr. et al. . | |
| 4,003,182 | 1/1977 | Wokas | 52/745.02 |
| 4,037,385 | 7/1977 | Wahlquist | 52/745.02 |
| 4,074,475 | 2/1978 | Wahlquist | 52/745.02 X |
| 4,161,850 | 7/1979 | Peterson et al. | 52/65 |
| 4,501,098 | 2/1985 | Gregory | 52/745.02 X |
| 4,525,975 | 7/1985 | McWethy | 52/234 X |
| 4,528,928 | 7/1985 | Virta et al. . | |
| 4,722,154 | 2/1988 | Virta et al. . | |
| 4,732,103 | 3/1988 | Culbertson | 114/71 X |
| 4,779,552 | 10/1988 | Harsia et al. | 114/71 X |
| 4,784,076 | 11/1988 | Carlsson . | |
| 4,959,933 | 10/1990 | Lappi . | |
| 5,335,614 | 8/1994 | Klaus . | |
| 5,369,920 | 12/1994 | Taylor | 52/79.5 X |

*Primary Examiner*—Beth Aubrey
*Assistant Examiner*—Brian E. Glessner
*Attorney, Agent, or Firm*—Howson & Howson

[57] ABSTRACT

After a deck is constructed on a ship, and before the next deck above it is constructed, prefabricated cabin modules are lifted by a crane from a pier, carried over the ship's hull, and deposited directly by the crane substantially at their final locations in a row spaced from the hull. Before the cabins are completed by the erection of wall elements that extend from the prefabricated cabin modules toward the hull, workers can attend to the construction of the overlying deck, and easily carry out the welding and outfitting operations needed to secure the overlying deck to the hull. Furnishings and fixtures for each cabin are concentrated and fixed within the prefabricated cabin modules, so that at least approximately 80% of the cabin construction labor is carried out ashore in the prefabrication process.

18 Claims, 4 Drawing Sheets

MODULAR SHIP'S CABIN AND METHOD OF INSTALLATION

BRIEF SUMMARY OF THE INVENTION

This invention relates to the construction of shipboard accommodations, and particularly to improvements in prefabricated modular cabins, the configuration of such cabins, and the methods by which they are installed aboard ship.

In the construction of ships, particularly large passenger ships, certain shipbuilders prefabricate entire cabins at an onshore site, and then carry them onto the ship and install them fully assembled. The use of prefabricated modular cabins reduces onboard outfitting time and consequently shortens the shipbuilding cycle. In addition, modular construction improves shipbuilding efficiency because it transfers field assembly work to a shop environment. Modular construction also reduces building costs because the standardization of the cabins allows assembly-line methods to be used. It also achieves a consistently higher and more uniform level of finish.

Onshore prefabrication of modular cabins, however, has some significant disadvantages which have discouraged their universal adoption. The cabins are large and therefore fragile. They are difficult and expensive to move, and it is not practical to attempt to transport them over long distances. Shipping costs are high because of the amount of "air" or empty space within the module. Moreover, the prefabricated modular cabins take up valuable space in the shipyard and, when they accumulate on a pier and holding area before being lifted onto a ship, they interfere with the movement of equipment and personnel.

Conventional prefabricated cabins are also difficult to maneuver onto the ship. The cabins require special lifting elevators; otherwise existing shipyard cranes must be diverted from other tasks. Lifting of the cabins requires special spreader frames. Large openings need to be cut into the hull of the ship so that the modular cabins can be moved onto a deck. Moreover, the entire deck must be underlaid. This increases construction costs, and adds to the weight of the ship, thereby increasing fuel consumption.

Once the modules are lifted aboard ship, they require air casters or other special moving devices, and when they are in place, they are extremely difficult to move.

The modules must be loaded in a precise sequence, and flawless execution of the cabin installation process is critical since installed cabins are difficult to move and preclude access to overhead and surrounding areas. After the cabins are clustered, they preclude all rework. With conventional modular cabins, the need to correct even a minor problem, such as a leaking pipe or a missed header weld above a cabin module, will cause delays having adverse effects throughout the shipyard.

Conventional prefabricated cabins are, of course, not suitable for ships having extensive steel bulkheads.

U.S. Pat. No. 4,959,933, to Lappi, discloses a modular ship cabin which is transported in a partially collapsed condition and which is expanded and assembled into a complete cabin after being located in position on the deck of a ship. Such a construction attempts to capture some of the aforementioned advantages of modularity while eliminating several of the aforementioned disadvantages. In Lappi, the cabin is collapsed in the direction of its shorter dimension to facilitate shipment over roads and by rail, and to facilitate movement of modules from the pier onto the ship and through the ship. However, the collapsed modules still occupy large portions of the floor area and volume of the completed modules. The collapsed modules are subject to various other problems on account of their relatively large sizes, including problems relating to fragility, shipping, lifting, and the sequencing of installation steps. Moreover they require hull openings for lateral movement onto a deck, and underlayment. The cabin construction described in the Lappi patent also restricts access to areas surrounding the cabin, particularly to areas adjacent to steel bulkheads and the hull.

Thus, while the aforementioned modular cabins and their installation procedures afford some improvements, there remains a need for a modular cabin component and installation process which provides the advantages of modular construction while avoiding most of the above-discussed disadvantages.

The principal object of this invention is to provide a prefabricated cabin module which minimizes the amount of construction and installation labor required aboard ship. Another object of the invention is to provide a prefabricated cabin module that is small in size and easily lifted and installed aboard ship. Still another object is to simplify and speed the shipbuilding process. More generally, it is an object of this invention to achieve one or more of the aforementioned advantages of modular cabin construction while eliminating one or more of the disadvantages of conventional modular cabin construction.

In accordance with the invention, accommodations are assembled by lifting, onto a deck of a partially assembled ship, a plurality of prefabricated cabin modules, and positioning the modules on the deck adjacent one another in a row extending in parallel relationship to a portion of the ship's hull adjacent to the deck. The cabin modules are spaced from the hull by a distance sufficient to permit workers to move about within the space. Wall elements are erected, or hinged and swung into place, so that they extend from the cabin modules toward the hull so that individual cabins are formed.

The invention provides the advantage that it permits "blue sky" construction. That is, after a deck is constructed on a ship, and before the next deck above it is constructed, cabin modules can be lifted by a crane from a pier, carried over the ship's hull, and deposited directly by the crane substantially at their final locations in a row spaced from the hull. Before the cabins are completed by the erection of the wall elements that extend from the prefabricated cabin modules toward the hull, workers can attend to the construction of the next deck, and easily carry out the welding operations needed to secure the deck to the hull. The space provided between the prefabricated modules and the hull allows workers to carry out other operations as well, including installation and inspection of utilities including water pipes, ventilation conduits, and electrical power and communications lines.

Preferably the prefabricated module includes a bathroom and/or furnishings fixed therein when it is lifted onto the deck. These elements are concentrated in the prefabricated module. The module itself, however, is designed so that it occupies as small a deck area as possible. Preferably, the lengths of its partition walls are less than the lengths of the extension wall elements which extend from the cabin modules toward the hull. Therefore, the floor area of the prefabricated module constitutes only a minor part (i.e. less than one-half) of the total floor area of the finished cabin. Further furnishings and fixtures can be installed in the space between the extension wall elements when the cabin is completed. Preferably, the man-hours of labor expended in the prefabrication of each cabin module, including the installation of the furnishing and fixtures therein before it is lifted onto the deck, are at least approximately four times the man-hours of labor expended in erecting the extension wall elements and installing fixtures and furnishings between said extension wall elements.

It will be apparent from the foregoing, and the following detailed description, that the prefabricated modular cabin of this invention, and the process for its installation, have many important advantages, especially the improved speed and efficiency which they afford to the overall shipbuilding process. Further objects and advantages of the invention will be apparent from the following detailed description, when read in conjunction with the drawings.

DETAILED DESCRIPTION

Figure 3:
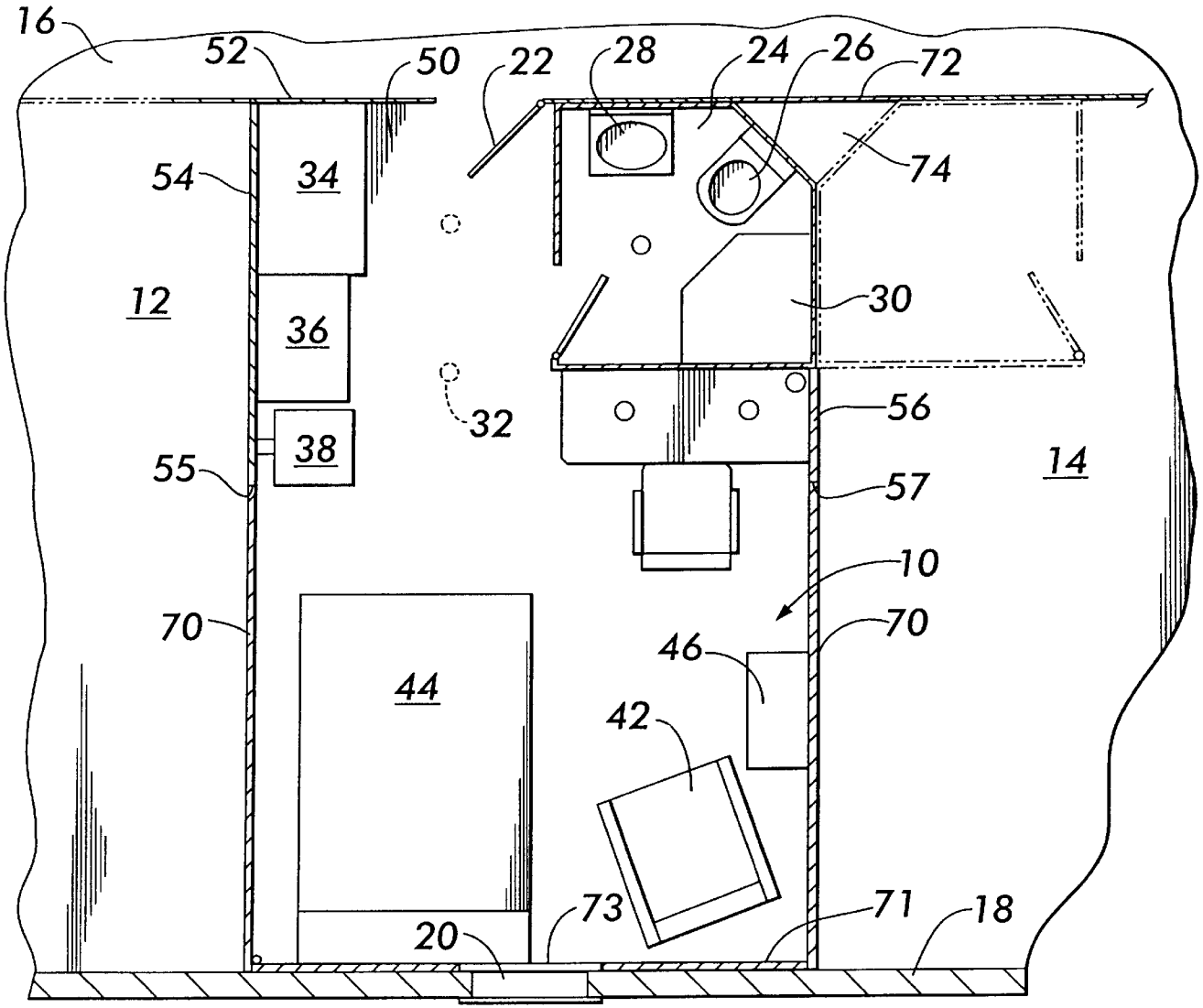
FIG. 3 is a plan view of the interior of a fully assembled cabin in accordance with the invention.

Large passenger ships typically include several decks, each having rows of similar cabins. The finished cabin, in accordance with the invention, an example of which is illustrated in FIG. 3, differs little from conventional ships' cabins. The cabin 10 is sandwiched between adjacent cabins, 12 and 14, and extends from an access passageway 16 to the hull 18 of the ship. A location adjacent the hull 18 is preferred because the cabin can then have a porthole 20.

The cabin 10 typically includes most of the conveniences of a hotel room, and its contents can vary depending on the degree of luxury for which it is designed. The cabin 10 is typically provided with a locking front access door 22, a bathroom unit 24 with toilet 26, a sink 28 and a shower 30, lighting fixtures 32, preferably recessed into a ceiling, clothing storage units such as a wardrobe 34 and a drawer chest 36, a television and television support 38, a desk 40, chairs 42, a bed 44, a book/radio shelf 46, a smoke detector, sprinklers, an intercom speaker and various piping, ventilation, wiring and cable-ways (not shown). Of course, other conveniences can be included.

The cabin of this invention differs from a conventional modular cabin in that the prefabricated module that is carried aboard ship occupies a deck area which is only a minor part (i.e. less than one-half) of the deck area occupied by the finished cabin. Moreover, the furnishings and fixtures for the cabin are concentrated in the prefabricated module, so that, in terms of man-hours, approximately 80% or more of the labor required for fabrication and installation of the cabin (i.e. the module itself and its electrical, piping and ventilation components) is carried out on shore in the fabrication process.

Figure 2:
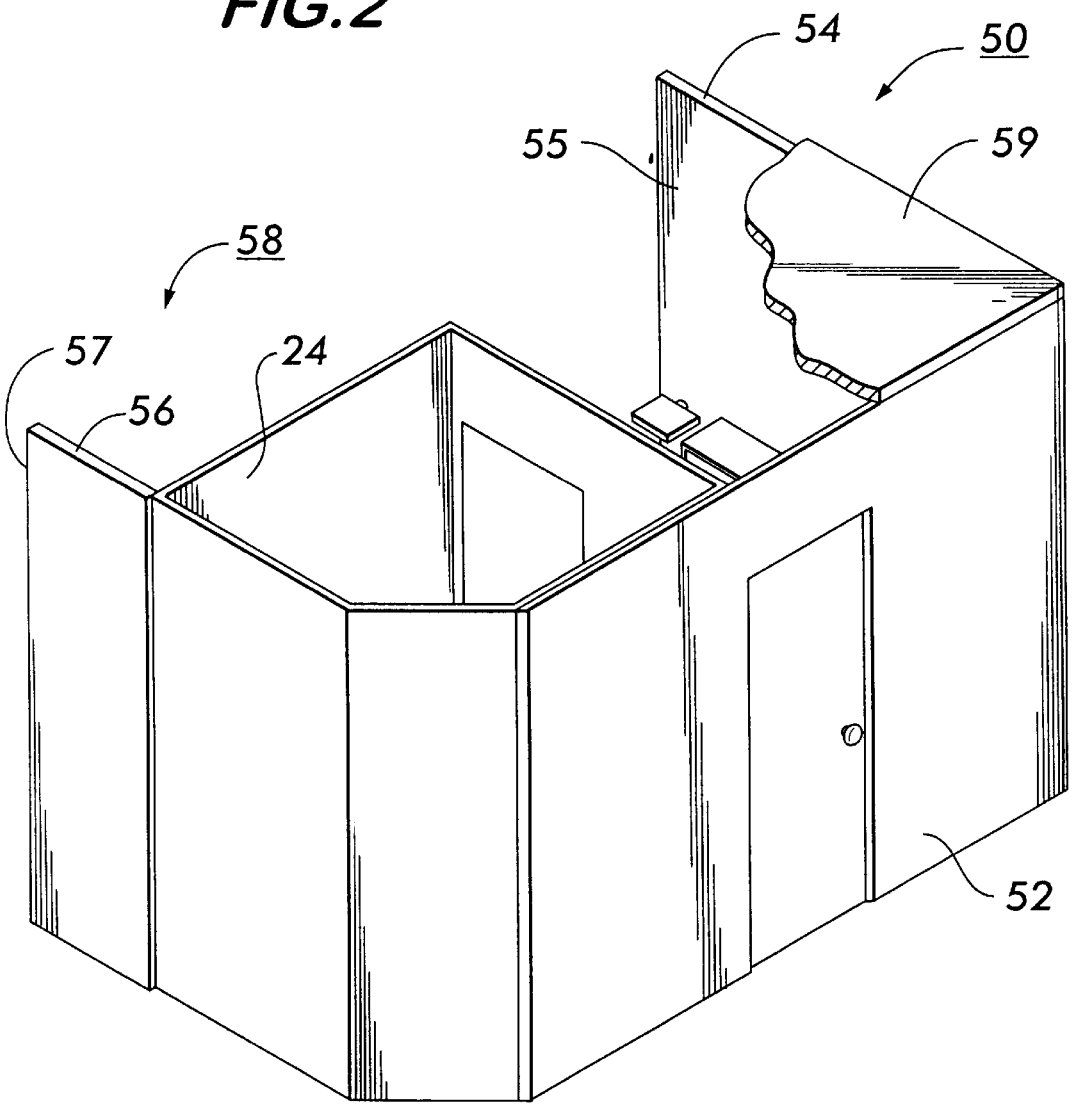
FIG. 2 is perspective view of a prefabricated cabin module of the invention, with a portion of its ceiling cut-away.

For instance, FIG. 2 illustrates a prefabricated cabin module 50, as built on shore by an assembly line process. This cabin module constitutes the front section of a fully assembled cabin as shown in FIG. 3. The cabin module 50 is a three-sided unit including a front wall 52, which faces an access passageway 16 (FIG. 3), and partition walls 54 and 56, which extend from the front wall 52 toward the hull 18, terminating in vertical edges 55 and 57. A part of the enclosure of bathroom unit 24 forms part of partition wall 56. FIG. 2 shows that the cabin module 50 has an open end 58, which faces the hull 18. The module also includes a ceiling 59. Only the bathroom unit 24 has a floor.

The relatively small size of the prefabricated cabin module 50 allows it to be easily stored, transported, and maneuvered onto the ship. The door 22 and the bathroom unit 24 are installed in the module on shore. Recessed lighting fixtures 32, an intercom speaker, a smoke detector, and various other elements such as piping, ventilation conduits, outlets, wiring, cable-ways and the like are also installed on shore. Furnishings and fixtures that remain within the module are preferably attached to the walls. For example, the clothing storage units 34 and 36, television and television support 38 and desk 40, as well as bathroom fixtures are preferably fixed within the prefabricated module as it is being built on shore. Optionally, other furnishings and fixtures, such as chairs 42, bed 44, shelf 46, etc., which will ultimately be located within the completed cabin closer to the hull, can be carried aboard ship within the prefabricated module.

Figure 1:
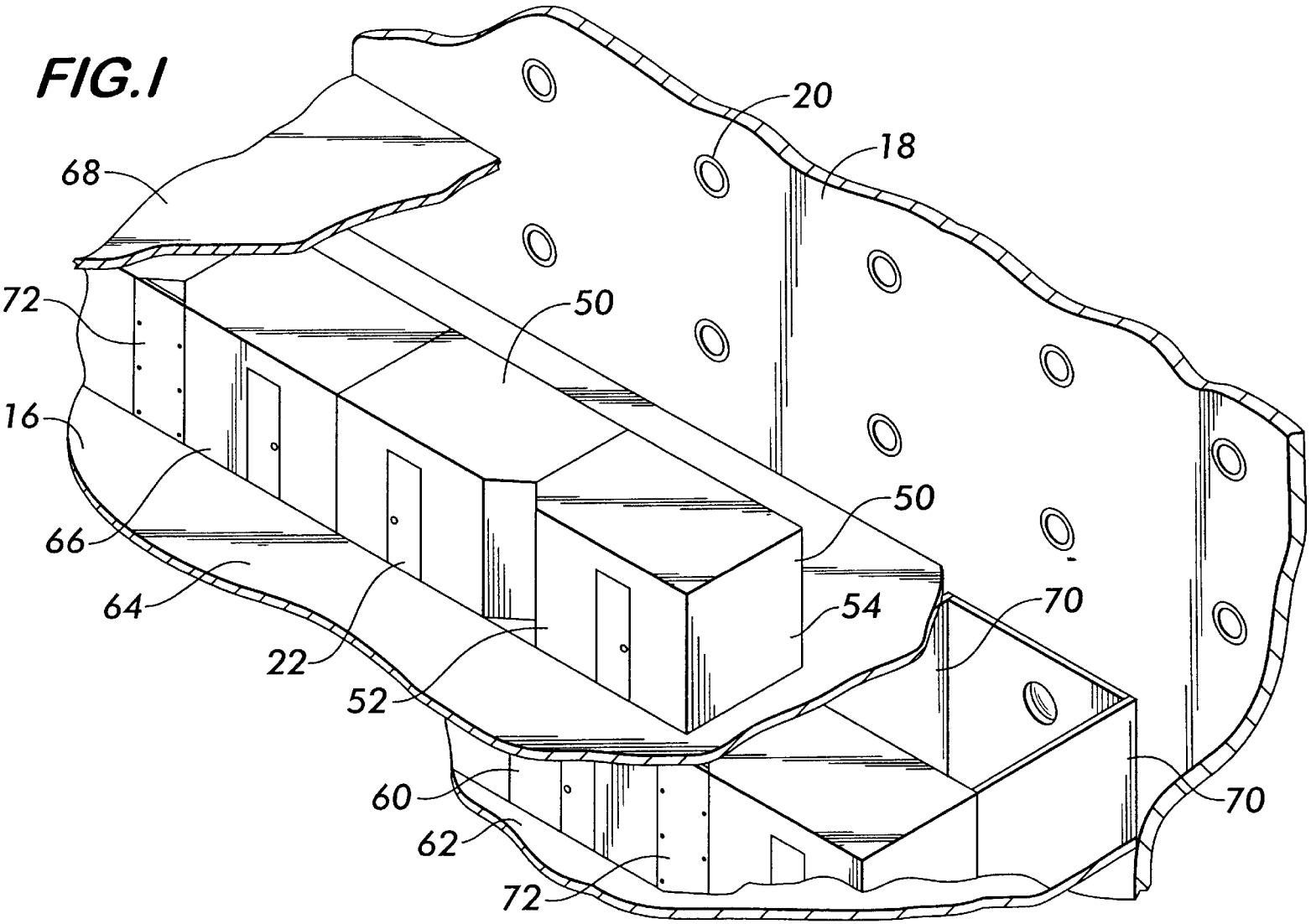
FIG. 1 is a perspective view of a part of a ship, with portions of its decks and hull cut-away and with cabins according to the invention located on the decks, and shown in various stages of assembly.

As shown in FIG. 1, a typical passenger ship has several decks for passenger accommodations, which are built progressively, one deck above another. In accordance with the invention, after a deck, or a section of a deck, is completed, prefabricated cabin modules are installed in a row on the completed deck or deck section before an overlying deck section is built. The cabin modules are lifted over the hull by a crane and lowered directly into their final positions. Relatively little horizontal movement of the modules is required. Any such horizontal movement required in order to align the modules is easily accomplished without special equipment, because of the relatively small size of the modules.

As shown in FIG. 1, after the row 60 of cabin modules 50 is positioned on deck 62, an overlying deck 64 is built. After the deck 64 is built, another row 66 of cabin modules 50 is positioned on the deck 64 and another overlying deck 68 is constructed.

Workers are able to move about within the space between row 60 of cabin modules and hull 18 to carry out the welding and other operations needed to complete deck 64. After the part of deck 64 the row 60 of cabin modules is completed, extension walls 70 are installed, extending from the cabin modules 50 to the hull 18. A finishing panel 71, having a porthole opening 73 is then installed along the hull 18.

In the preferred embodiment of the invention, the horizontal lengths of the extension walls 70 are less than the lengths of the partition walls of the module 50. Thus, the width of the prefabricated module, measured athwartship, is less than one-half the width of the finished cabin.

Various furnishings and fixtures not prefabricated into the cabin module 50 can then be installed in the spaces between extension walls 70. Ceiling sections (not shown) can be then installed between the upper edges of the extension walls, and finishing panels (not shown) can be installed against the hull. Access panels 72 are installed on the front walls 52 of the cabins to enclose utility chases 74. The above-described installations are simple and require a relatively small amount of labor.

The extension walls 70 and the finishing panels can be carried aboard the ship separately from the cabin modules.

However, if the extension walls 70 are not longer than the width of the cabin module, they can be temporarily fixed across the open end 58 of the cabin module 50 as it is lifted onto the ship, thus providing security and protection for the contents of the module.

Figure 4:
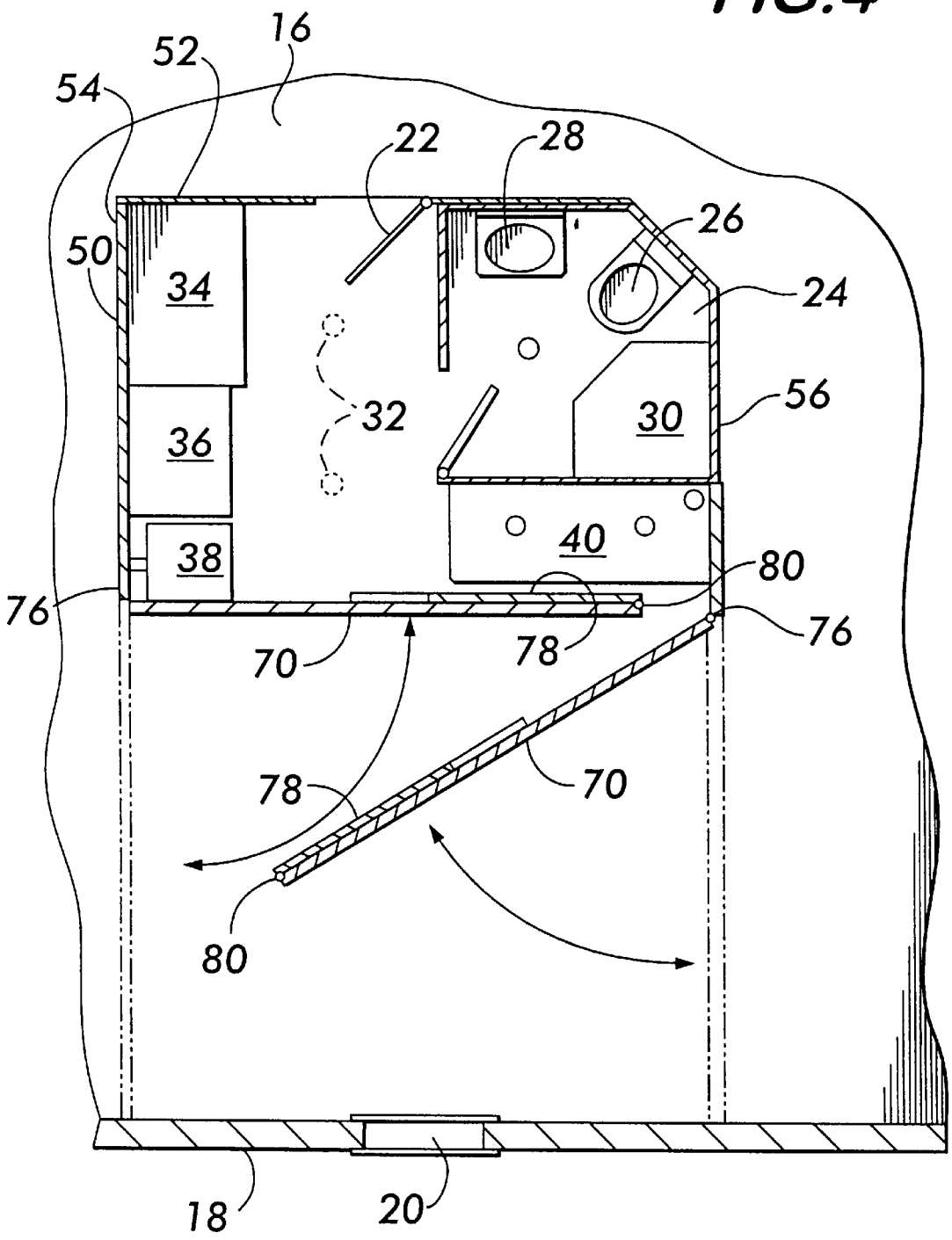
FIG. 4 is a plan view of an alternative embodiment of a cabin module in accordance with the invention, in which the prefabricated module has hinged walls, which are used to complete the assembly of the cabin.

In an alternative embodiment, illustrated in FIG. 4, the extension walls 70 are connected to the cabin module 50 by hinges 76, and finishing panels 78 are connected to extension walls 70 by hinges 80. Thus, during storage and transportation onshore and as the modules are carried aboard ship, the extension walls 70 are temporarily secured in overlapping relationship across the opening of the module. After completion of the deck welding and outfitting operations in the space between a module and the hull, the extension walls 70 are swung outwardly about the hinges 76 so that they extend to the hull 18. The finishing panels 78 are then swung into position against the hull. The finishing panels 78 are preferably provided with notches (not shown) which together form an opening aligned with the porthole 20.

The invention provides a unique and advantageous method of installing cabins aboard ship, by concentrating the cabin-fabrication labor at an offshore assembly site. It also facilitates the overall shipbuilding operation by permitting "blue sky" construction. That is, it provides for installation of cabin modules by lowering them directly into their final positions on a deck, before the next overlying deck is built. Nevertheless, space is provided allowing workers to weld the overlying deck to the ship's hull, and relatively little labor is required to complete the cabins after the overlying deck work is completed.

Various modifications can be made to the cabin modules and installation method described above. For example, each cabin module can be provided with only one, rather than two extension walls, since, if the extension walls have adequate sound attenuation and fire resistance, it is unnecessary to provide double walls. An additional panel can be provided to complete the endmost cabin in a row. Many other modifications, which will occur to persons skilled in the art, after having read the foregoing description, can be made without departing from the scope of the invention as defined in the following claims.

What is claimed is:

1. A method of assembling accommodations aboard a ship comprising the steps of:

lifting onto a deck of a partially assembled ship a plurality of prefabricated cabin modules;

positioning the modules, on said deck, adjacent one another in a row extending in parallel relationship to a portion of the ship's hull adjacent to said deck, the cabin modules being spaced from the hull, the space between the cabin modules and the hull being sufficient for a worker to move about within said space;

after positioning the modules on said deck in said row, installing another deck above the cabin modules, and fastening said another deck to said portion of the hull by fastening procedures carried out at least in part by a worker while located within said space; and after fastening said another deck to said portion of the hull, erecting wall elements extending across said space from said cabin modules toward the hull, whereby individual cabins are formed, each individual cabin being defined in part by one of said modules and two of said wall elements.

2. A method according to claim 1, including the step of erecting finishing panels along the hull.

3. A method according to claim 1, in which each prefabricated cabin module has a ceiling, and in which, after fastening said another deck to said portion of the hull, a ceiling extension is erected, extending from the ceilings of the prefabricated cabin modules toward said portion of the hull.

4. A method according to claim 1, in which each of the prefabricated cabin modules includes furnishings fixed therein when it is lifted onto the deck in said lifting step.

5. A method according to claim 1, in which each of the prefabricated cabin modules includes a bathroom fixed therein when it is lifted onto the deck in said lifting step.

6. A method according to claim 1, in which each of the prefabricated cabin modules includes a bathroom, and furnishings, fixed therein when it is lifted onto the deck in said lifting step.

7. A method according to claim 1, in which, in said lifting step, the cabin modules are lifted over the ship's hull by a crane and deposited by the crane substantially at their final positions in said row.

8. A method of assembling accommodations aboard a ship comprising the steps of:

lifting onto a deck of a partially assembled ship a plurality of prefabricated cabin modules, each comprising at a first wall for separating the interior of the cabin from a common access passageway, and a pair of partition walls extending in a first direction from the first wall, the prefabricated cabin module having an opening located opposite to the first wall;

positioning the modules, on said deck, adjacent one another in a row extending in parallel relationship to a portion of the ship's hull adjacent to said deck, the cabin modules being spaced from the hull and having their openings facing said portion of the hull, the space between the cabin modules and the hull being sufficient for a worker to move about within said space;

after positioning the modules on said deck in said row, installing another deck above the cabin modules, and fastening said another deck to said portion of the hull by fastening procedures carried out at least in part by a worker while located within said space; and after fastening said another deck to said portion of the hull, erecting extension wall elements extending across said space from said partition walls toward the hull, whereby individual cabins are formed, each individual cabin being defined in part by one of said modules and two of said wall elements.

9. A method according to claim 8 including the step of erecting finishing walls along the hull, whereby individual cabins are bounded on one side by a said first wall, on an opposite side by a finishing wall, and on the remaining sides by walls, each comprising one of said partition walls and an extension wall element.

10. A method according to claim 9, in which each prefabricated cabin module has a ceiling, and in which, after fastening said another deck to said portion of the hull, a ceiling extension is erected, extending from the ceilings of the prefabricated cabin modules toward said portion of the hull.

11. A method according to claim 9, in which each of the prefabricated cabin modules includes furnishings fixed therein when it is lifted onto the deck in said lifting step.

12. A method according to claim 9, in which each of the prefabricated cabin modules includes a bathroom fixed therein when it is lifted onto the deck in said lifting step.

13. A method according to claim 9, in which each of the prefabricated cabin modules includes a bathroom, and furnishings, fixed therein when it is lifted onto the deck in said lifting step.

14. A method according to claim 9, in which, in said lifting step, the cabin modules are lifted over the ship's hull by a crane and deposited by the crane substantially at their final positions in said row.

15. A method according to claim 9, in which the horizontal length of each partition wall is less than the horizontal length of each extension wall element, and the horizontal length of the first wall is at least as great as the horizontal length of each partition wall.

16. A method according to claim 9, in which the extension wall elements are connected by hinges to partition walls of the prefabricated cabin modules when the prefabricated cabin modules are lifted onto the deck in the lifting step, and in which the extension wall elements are erected by swinging them on the hinges toward said portion of the hull.

17. A method according to claim 16 in which finishing wall elements are connected to the extension wall elements by hinges, and in which, following erection of each extension wall element having a finishing wall element hinged thereto, the last-mentioned finishing wall element is swung into a position in which it extends along the ship's hull.

18. A method according to claim 9, including the step of prefabricating said cabin modules, in which, in the prefabricating step, furnishings and fixtures are installed into the cabin module before it is lifted onto the deck in said lifting step, and also including the step of installing furnishings and fixtures between said extension wall elements after they are erected, wherein the man-hours of labor expended in the prefabrication of each cabin module, including the installation of the furnishing and fixtures therein before it is lifted onto the deck, are a minimum of approximately four times the man-hours of labor expended in erecting the extension wall elements and installing fixtures and furnishings between said extension wall elements.

* * * * *